US005343117A

United States Patent [19]

Wyner et al.

[11] Patent Number: 5,343,117

[45] Date of Patent: Aug. 30, 1994

[54] ELECTRODE FEEDTHROUGH CONNECTION STRAP FOR ARC DISCHARGE LAMP

[75] Inventors: Elliot Wyner, Peabody; Robert White, Beverly; Semyon Makhlis, Brookline; Ernest Davey, Jr., Salem, all of Mass.

[73] Assignee: OSRAM Sylvania Inc., Danvers, Mass.

[21] Appl. No.: 47,341

[22] Filed: Apr. 19, 1993

Related U.S. Application Data

[63] Continuation of Ser. No. 450,651, Dec. 14, 1989, abandoned.

[51] Int. Cl.[5] ..... H01J 61/36; H01J 9/32

[52] U.S. Cl. ..... 313/623; 313/625; 313/624; 313/631; 445/29; 445/35; 445/44

[58] Field of Search ..... 313/623, 624, 625, 631, 313/283, 284, 292, 331, 632, 332, 565; 445/26, 29, 35, 44, 46, 49

[56] References Cited

U.S. PATENT DOCUMENTS

| | | | |
|---|---|---|---|
| 4,035,682 | 7/1977 | Bubar | 313/565 |
| 4,065,691 | 12/1977 | McVey | 313/623 X |
| 4,199,704 | 4/1980 | Varshneya et al. | 313/623 |
| 4,342,938 | 8/1982 | Strok | 313/565 |
| 4,539,511 | 9/1985 | Denbigh | 313/624 |
| 4,545,799 | 10/1985 | Rhodes | 313/623 X |
| 4,584,454 | 4/1986 | Feuersanger et al. | 445/26 X |
| 4,713,580 | 12/1987 | Schoene | 313/624 |
| 4,804,889 | 2/1989 | Reid | 313/624 |
| 4,808,881 | 2/1989 | Kariya et al. | 313/624 |
| 4,827,190 | 5/1989 | Masui | 313/624 |

FOREIGN PATENT DOCUMENTS

| | | |
|---|---|---|
| 0225944 | 6/1987 | European Pat. Off. . |
| 0265266 | 4/1988 | European Pat. Off. . |

*Primary Examiner*—Donald J. Yusko
*Assistant Examiner*—Ashok Patel
*Attorney, Agent, or Firm*—Joseph S. Romanow; William H. McNeill

[57] ABSTRACT

An electrode feedthrough assembly for a ceramic arc tube of the type used in high pressure sodium arc lamps. The electrode feedthrough assembly is particularly useful in an external reservoir arc tube wherein an interior region of a feedthrough tube is utilized as a reservoir for the lamp fill material. The electrode feedthrough assembly includes a feedthrough tube, an electrode assembly attached to the feedthrough tube and a connection wire. The feedthrough tube has a closed end external to the arc tube. The feedthrough tube and the closed end thereof are formed in a single process, preferably by deep drawing, without welding, crimping or fusing. Passages to the interior of the feedthrough tube are provided by crimping the electrode support rod to the feedthrough tube with a six jaw crimping arrangement wherein two of the crimping jaws are shorter than the other four. The connection wire is attached to the feedthrough tube and includes a portion on the axis of the tube. The connection wire assists in retaining the electrode feedthrough assembly in the arc tube during sealing.

10 Claims, 3 Drawing Sheets

ELECTRODE FEEDTHROUGH CONNECTION STRAP FOR ARC DISCHARGE LAMP

CROSS REFERENCE TO RELATED APPLICATIONS

This is a continuation of copending application Ser. No. 07/450,651, filed on Dec. 14, 1989, now abandoned. This application discloses, but does not claim, subject matter which is claimed in U.S. Ser. No. 07/450,648 entitled "Electrode-To-Feedthrough Tube Crimp For Arc Discharge Lamp" now abandoned, and U.S. Ser. No. 07/450,644 entitled "Electrode Feedthrough Tube For Arc Tube Discharge Lamp", now abandoned, both filed concurrently herewith and assigned to the assignee of this application.

FIELD OF THE INVENTION

This invention relates to arc tube assemblies for high pressure arc discharge lamps and, more particularly, to electrode feedthrough structures and methods of manufacturing such structures.

BACKGROUND OF THE INVENTION

High pressure sodium arc lamps have been in commercial production for many years and have been subject to many improvements in design, materials and processing. Such lamps include a translucent ceramic arc tube, an outer envelope including an electrical connector, and a frame for supporting the arc tube within the outer envelope. The frame is electrically conductive and carries power to the arc tube. The arc tube is typically fabricated from polycrystalline alumina or yttria and contains an amalgam of mercury and sodium for producing light having a desired output spectrum. Tungsten or molybdenum electrodes are positioned within the arc tube at opposite ends and are attached to feedthroughs selected to have thermal expansion characteristics closely matched to those of the ceramic arc tube. The feedthroughs are hermetically sealed in openings at opposite ends of the arc tube. Niobium, usually containing about 1% zirconium by weight, is the preferred feedthrough material for alumina arc tubes.

A variety of electrode feedthrough structures and techniques for hermetically sealing the feedthroughs to the arc tube are known in the art. In one commonly used structure, the feedthrough is a niobium tube. A tungsten coil electrode is attached to the niobium tube by a tungsten electrode support rod. The opening in each end of the arc tube is sufficiently large for insertion of the electrode and the niobium tube. An insert button is sintered directly into the end of the arc tube, and a ceramic sealing button or ring is sealed with a low melting point ceramic frit to the end of the arc tube over the feedthrough to extend the length of the seal and to improve its reliability. Such a structure is disclosed in U.S. Pat. No. 4,539,511. An alternative construction utilizes an arc tube without an insert. A sealing button having a groove to aid in flow of the sealing material is disclosed in U.S. Pat. No. 4,713,580 issued Dec. 15, 1987 to Schoene. An arc tube construction which utilizes a connection wire to position a feedthrough tube in the arc tube during sealing is disclosed in U.S. Pat. No. 4,804,889 issued Feb. 14, 1989 to Reid et al.

It is known in the prior art to construct high pressure sodium arc lamps so that the interior of the electrode feedthrough tube and the discharge region in the ceramic arc tube are interconnected by a passage of sufficient cross section to permit flow of the vaporized fill material. The interior of the feedthrough tube typically operates at a lower temperature than the arc tube. Therefore, the fill material tends to condense in the feedthrough tube. This construction is commonly referred to as an external reservoir arc tube, since the fill material condenses in a region external to the discharge region. External reservoir construction is disclosed in U.S. Pat. No. 4,342,938 issued Aug. 3, 1982 to Strok, European Patent Application No. 0,225,944 published Jun. 24, 1987, U.S. Pat. No. 4,827,190 issued May 2, 1989 to Masui et al, European Patent Application No. 0,265,266 published Apr. 27, 1988, U.S. Pat. No. 4,035,682 issued Jul. 12, 1977 to Bubar and U.S. Pat. No. 4,065,691 issued Dec. 27, 1977 to McVey. The external reservoir arc lamp construction is believed to provide lower sodium loss than conventional arc lamps and to provide a more constant level of light output over the life of the arc lamp.

In developing an external reservoir, high pressure sodium arc lamp suitable for high volume production, a number of practical requirements must be met. The arc lamp assembly including the electrode feedthrough having an external reservoir must have a low manufacturing cost. The electrode feedthrough tube which defines the external reservoir must be hermetically sealed at its outer end and must have a passage at or near its inner end interconnecting the interior of the tube and the discharge region within the arc tube. The passage must be of sufficient cross-section to permit flow of vaporized fill material, but must not be so large as to permit droplets of fill material to pass from the external reservoir into the discharge region. In addition, the rod which supports the tungsten electrode must have a reliable connection, both electrically and mechanically, to the electrode feedthrough tube. Finally, the external portion of the feedthrough tube must be electrically connected to the lamp frame.

These requirements have been addressed in various ways in the prior art. However, none have proven entirely satisfactory. For example, aforementioned U.S. Pat. No. 4,827,190 and European Patent Application No. 0,225,944 disclose a feedthrough construction wherein the feedthrough tube is hermetically sealed by fusing the outer end of the tube. This technique adds an extra step to the lamp fabrication process and requires a heat absorbing plate to be used during the fusing process. In addition, there is a risk that the fused end will leak. The aforementioned U.S. Pat. No. 4,342,938 discloses a construction wherein the external end of the feedthrough tube is crimped and welded to provide hermetic sealing. The possibility of a leak also exists in this construction.

In the above patents, an aperture is provided in the wall of the feedthrough tube to interconnect the interior of the tube and the discharge region. An additional step is required to form the aperture. In European Patent Application No. 0,265,266, the electrode feedthrough tube is flattened against the electrode support rod by mechanical deformation, leaving capillary passages between the interior of the feedthrough tube and the discharge region. The disclosed configuration has four lobes in the deformed portion of the feedthrough tube. A disadvantage of the disclosed configuration is that portions of the tube in the deformed region often extend beyond the outside diameter of the feedthrough, thereby making it impossible for the feedthrough tube and the electrode to be inserted through the opening in the ceramic arc tube during assembly.

It is a general object of the present invention to provide improved ceramic arc tube assemblies for high pressure discharge lamps.

It is another object of the present invention to provide improved electrode feedthrough assemblies for high pressure discharge lamps.

It is still another object of the present invention to provide ceramic arc tube assemblies which are low in cost and easy to manufacture.

It is a further object of the present invention to provide improved methods for manufacturing ceramic arc tube assemblies.

SUMMARY OF THE INVENTION

According to the present invention, these and other objects and advantages are achieved in a ceramic arc tube assembly comprising a ceramic arc tube having an opening in at least one end, an electrode feedthrough sealed in the opening, the electrode feedthrough comprising a conductive tube closely matched in thermal characteristics to the arc tube, a conductive strap electrically and mechanically coupled to the conductive tube outside the arc tube, the conductive strap including a first section that at least partially encircles the conductive tube and is attached thereto, a second section extending along an axis of the conductive tube and a third section that interconnects the first and second sections, and an electrode assembly coupled to the electrode feedthrough in an interior of the arc tube.

The conductive strap is preferably thermally matched to the electrode feedthrough. In a preferred embodiment, the electrode feedthrough and the conductive strap comprise niobium. The conductive strap preferably includes a surface that matches the surface of the electrode feedthrough to facilitate contact between the strap and the electrode feedthrough. The matching of surfaces can be effected by providing a wire having a flattened surface and wrapping the flattened surface around the electrode feedthrough in contact therewith.

According to another aspect of the invention, there is provided a method of manufacturing an arc tube assembly comprising the steps of providing a ceramic arc tube having an opening in at least one end thereof and an electrode feedthrough comprising a conductive tube closely matched in thermal characteristics to the arc tube, attaching a conductive strap to the electrode feedthrough, the conductive strap including a first section that at least partially encircles the conductive tube and is attached thereto, a second section extending along an axis of the conductive tube and a third section that interconnects the first and second sections, positioning the electrode feedthrough in the opening in the arc tube with the first section of the conductive strap in contact with the periphery of the opening, and sealing the electrode feedthrough in the opening by heating a sealing material located between the electrode feedthrough and the arc tube.

Preferably, the electrode feedthrough is retained in a fixed position relative to the arc tube during the step of sealing the electrode feedthrough in the opening by positioning a fixed member in axial contact with the third section of the conductive strap. Thus, the electrode feedthrough is prevented from moving in the event of positive pressure within the arc tube during the sealing process.

Preferably, the conductive strap is welded to the electrode feedthrough, and most preferably, the conductive strap is attached to the electrode feedthrough by laser welding.

BRIEF DESCRIPTION OF THE DRAWINGS

For a better understanding of the present invention together with other and further objects, advantages and capabilities thereof, reference is made to the accompanying drawings which are incorporated herein by reference and in which.

DETAILED DESCRIPTION OF THE INVENTION

Figure 1:
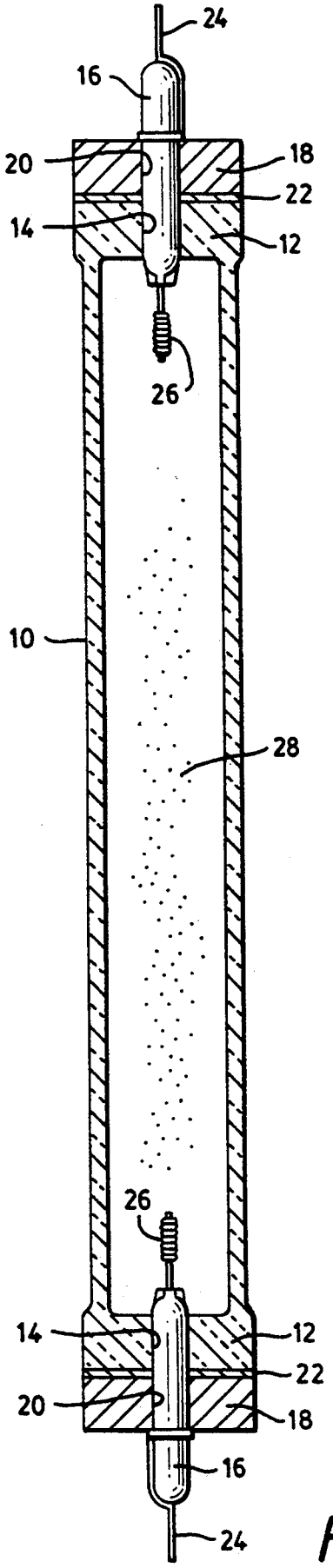
FIG. 1 is a cross-sectional view of a ceramic arc tube assembly in accordance with the invention.

A cross-sectional view of an arc tube assembly in accordance with the present invention is shown in FIG. 1. The arc tube assembly is typically utilized in a high pressure sodium arc discharge lamp, but may be utilized in any lamp requiring a translucent ceramic arc tube. A ceramic arc tube 10 has a generally cylindrical shape and has an end member 12 or insert button sealed in each end. End member 12 may be integral with the wall of arc tube 10, may be directly sealed to arc tube 10 as disclosed in U.S. Pat. No. 4,545,799 or may be sealed with an appropriate sealing frit. Each end member 12 includes a centrally located opening 14 for an electrode feedthrough tube 16. A sealing ring 18 is positioned over end member 12 and has an opening 20 aligned with opening 14. Electrode feedthrough tube 16 extends through opening 20 in sealing ring 18 and opening 14 in end member 12. A sealing frit 22 is located in the annular region between end member 12 and feedthrough tube 16, in the annular region between sealing ring 18 and feedthrough tube 16 and between end member 12 and sealing ring 18 to provide a reliable seal of the arc tube assembly. The external end of feedthrough tube 16 outside the arc tube 10 is welded to a refractory connection wire 24. The internal end of feedthrough 16 inside arc tube 10 is connected to an electrode assembly 26.

Preferably, the arc tube 10, end member 12 and sealing ring 18 are polycrystalline alumina, and the feedthrough tube 16 is a niobium tube. The niobium feedthrough tube 16 preferably contains about 1% zirconium by weight. Niobium is used because its thermal expansion characteristics closely match those of the alumina. Alternatively, the ceramic members 10, 12 and 18 can be yttria or another suitable material. The arc tube assembly contains a fill material such as a sodium mercury amalgam and a gas such as xenon. During operation, the fill material supports an arc discharge in a discharge region 28 between electrode assemblies 26.

Figure 2:
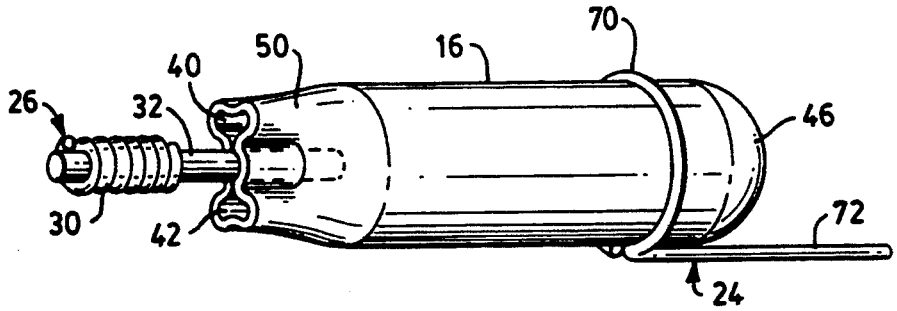
FIG. 2 shows an electrode feedthrough assembly in accordance with the present invention.

A preferred embodiment of the electrode feedthrough assembly of the present invention is shown in FIG. 2. The electrode feedthrough assembly includes feedthrough tube 16, connection wire 24 and electrode assembly 26. The electrode assembly 26 includes an electrode coil 30 disposed on an electrode support rod 32. Typically, the electrode coil 30 and the electrode support 32 are tungsten.

The electrode feedthrough assembly of the present invention is designed to provide an external reservoir for the fill material which supports an arc discharge in discharge region 28 within arc tube 10. As used herein, the term "external reservoir" refers to an interior region 36 of feedthrough tube 16 which is partially isolated from the discharge region 28 in the ceramic arc tube 10 and is totally isolated from the ambient environment surrounding the arc tube assembly. The interior of feedthrough tube 16 is connected by passages 40 and 42 to the discharge region 28 in the arc tube 10. The outer end 46 of feedthrough tube 16 external to the arc tube 10 is hermetically sealed.

In operation, the electrode feedthrough tube 16 tends to be cooler than the discharge region 28 and the adjacent portions of arc tube 10. Therefore, any excess fill material condenses in the relatively cooler interior region 36 of feedthrough tube 16. In arc lamps not having external reservoirs, excess fill material simply condenses in the coolest portion of arc tube 10. As known in the art, the external reservoir configuration provides desirable operating characteristics.

Referring again to FIG. 2, the feedthrough tube 16 is a generally cylindrical, niobium tube having a length on the order of 12 mm and a wall thickness on the order of 0.25 mm. Different diameter feedthrough tubes are used, depending on the size of the arc tube. The outer end 46 of feedthrough tube 16 external to arc tube 10 is hermetically sealed and typically has a generally hemispherical shape, although the shape is not critical to operation. The principal requirement is that the outer end 46 hermetically seal the feedthrough tube 16 over the life of the lamp. The feedthrough tube 16 and sealed outer end 46 are formed in the same process without welding, crimping or fusing of end 46. The feedthrough tube 16 is formed from a continuous piece of solid metal into a tube having one end closed. Thus, no additional steps are required to close and seal outer end 46.

Preferably, the feedthrough tube 16 is formed by deep drawing. Deep drawing is a known metal fabrication technique which is utilized to form both the cylindrical wall of feedthrough tube 16 and the closed outer end 46 in a single operation. Therefore, additional crimping, welding or fusing steps are not required to hermetically seal feedthrough tube 16. As a result of the deep drawing process, the wall thickness in the outer end 46 is approximately the same as the wall thickness of the cylindrical wall. The potential for leaks is much lower for the deep drawn feedthrough tube than for tubes closed by the crimping, welding or fusing techniques of the prior art.

In accordance with another aspect of the invention, a novel crimping technique is utilized to attach the feedthrough tube 16 to electrode support rod 32. The electrode feedthrough tube 16 is deformed around the support rod 32 to form a crimp 50 which retains the electrode assembly 26 and also defines passages 40 and 42 to the interior region 36 of the electrode tube 16. The crimp 50 and its method of fabrication are illustrated in more detail in FIG. 4 which is an enlarged cross-sectional view of crimp 50, feedthrough tube 16 and support rod 32. The crimp 50 includes first lobe portions 52 which retain the electrode support rod 32 and second lobe portions 54 which define passages 40 and 42 to the interior region 36 of the feedthrough tube 16. The first lobe portions 52 substantially surround the electrode rod 32 and mechanically support it. The first lobe portions 52 can be tack welded to electrode support rod 32 to further insure the integrity of the mechanical and electrical connection. The second lobe portions 54 are located between electrode support rod 32 and the outside diameter of feedthrough tube 16. The second lobe portion 54 can have any convenient shape but should be formed such that no portion of the crimp 50 extends beyond the outside diameter of feedthrough tube 16. This requirement insures that the electrode feedthrough assembly can be inserted through openings 14 and 20 during the fabrication process.

Figure 4:
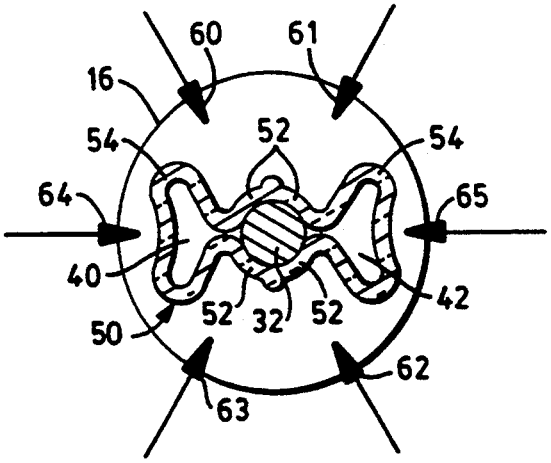
FIG. 4 is an enlarged schematic illustration showing crimping of the electrode feedthrough tube to the electrode support rod.

A preferred technique for forming crimp 50 is illustrated schematically in FIG. 4. A first set of four crimping jaws 60, 61, 62 and 63 are used to form first lobe portions 52, and a second set of crimping jaws 64 and 65 are used to form second lobe portions 54. The crimping jaws 64 and 65 are positioned on opposite sides of the region of feedthrough tube 16 to be crimped. The crimping jaws 60–63 are spaced apart between crimping jaws 64 and 65. Crimping jaws 60 and 62 are positioned opposite each other, and crimping jaws 61 and 63 are positioned opposite each other. The crimping jaws 60–65 are preferably equiangularly spaced around the crimp region.

The crimping jaws 60–63 are moved radially inward and form first lobe portions 52. Simultaneously, the crimping jaws 64 and 65 are moved inwardly and form second lobe portions 54. The crimping jaws 64 and 65 are preferably shorter than the crimping jaws 60–63. As a result, the second lobe portions 54 are larger than lobe portions 52 and define passages 40 and 42. It is noted that the crimping jaws 64 and 65 are dimensioned to insure that second lobe portions 54 do not extend beyond the outside diameter of feedthrough tube 16. The crimping jaws 60–65 can have a wedge shape. The crimping arrangement shown and described herein meets the requirements of providing one or more passages between the interior region 36 of feedthrough tube 16 and the discharge region 28, insuring that the crimp 50 is maintained at a diameter less than the diameter of feedthrough tube 16 and providing a reliable connection between feedthrough tube 16 and electrode support rod 32.

The crimp 50 which holds the electrode support rod 32 in place, must provide passages 40 and 42 that are sufficiently large to permit flow of gases between discharge region 28 and the interior region 36 of feedthrough tube 16. In a prior art six point crimping tool having equally-dimensioned crimping jaws, the crimp would seal entirely or provide only microscopic passages. When four crimping jaws were used, the lobes of the crimp were too large to pass through the openings in the end of the arc tube. The above-described technique uses four crimping jaws to form the first lobe portions 52 which retain the electrode support rod 32 and two crimping jaws shape the second lobe portions 54. The crimping jaws are adjusted to maximize the passage of gases into the interior of feedthrough tube 16, while insuring that the crimp is entirely contained within the outside diameter of the feedthrough tube 16.

Electrode support rods of 0.047 inch, 0.0355 inch and 0.028 inch diameters were crimped onto niobium tubing of 0.156 inch outside diameter. Electrode support rods of 0.028 inch diameter were crimped onto niobium tubing of 0.085 inch outside diameter. A tack weld was formed at the interface between the niobium tube and the electrode support rod 32. By careful adjustment of the crimping jaws 64 and 65 which determine the dimension of second lobe portions 54, adequate clearance to allow the assembly to pass through the openings in the arc tube was obtained. These electrode assemblies were sealed into arc tubes. In operation of sodium mercury lamps with unsaturated vapor dosing, no problems were observed with the above-described crimp. In 400 watt, unsaturated vapor lamps, having a dose of 3.0 milligrams, 3.4% by weight sodium in arc tubes of 8.8 millimeters inside diameter by 108 millimeters cavity length, no problems were observed. The total cross-sectional area of passages 40 and 42 was about 0.9 square millimeter with electrode support rods of 0.0355 inch diameter. In another example, arc tubes having 4 millimeter inside diameter and 50 millimeter cavity length were successfully processed, with the area of passages 40, 42 being about 0.2 square millimeter using a 0.028 inch diameter electrode support rod.

The connection wire or strap 24 is a conductive element which electrically and mechanically connects feedthrough tube 16 to a frame (not shown) within the outer envelope of the arc lamp. The connection wire 24 includes a circumferential portion 70 which at least partially encircles the feedthrough tube 16 and a portion 72 which extends along the conductive tube 16 in an axial direction and interconnects portion 70 to the frame. The circumferential portion 70 is preferably welded to the feedthrough tube 16 at one or more points. It is preferable that the strap 24 be of the same material as the feedthrough tube 16, thereby avoiding failure of the weld caused by expansion and contraction of materials with dissimilar expansion coefficients. Thus, the strap 24 is preferably niobium. The weld between the feedthrough tube 16 and the circumferential portion 70 is particularly critical relative to thermally-induced failure. The weld of the portion 72 to the frame is less failure prone because it operates at a cooler temperature.

Figure 3:
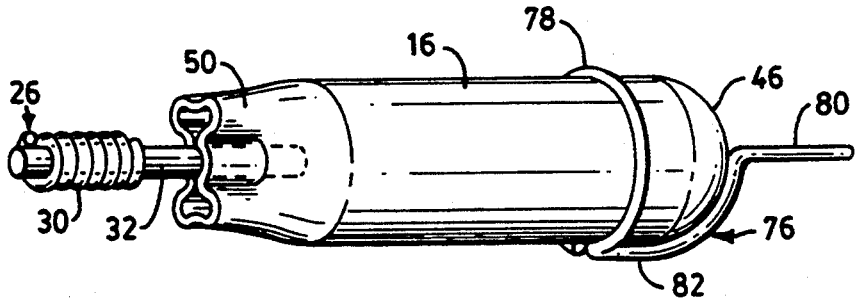
FIG. 3 shows an alternate embodiment of an electrode feedthrough assembly in accordance with the present invention.
Figure 5:
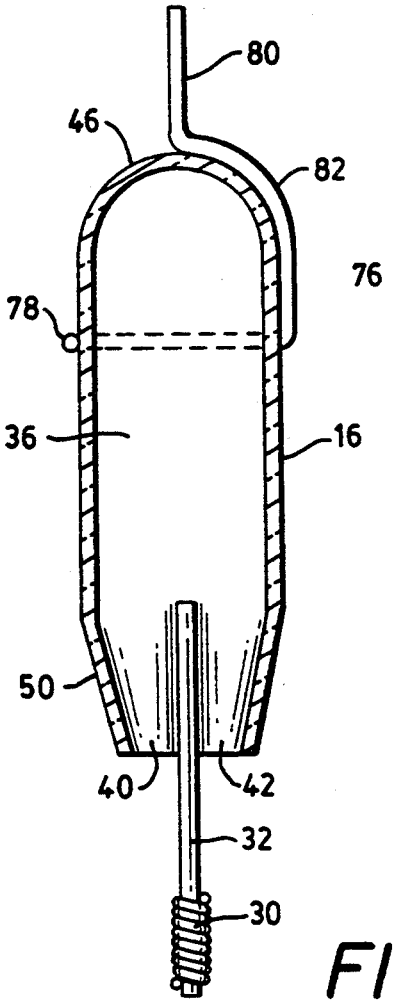
FIG. 5 is a cross-sectional view of the electrode feedthrough assembly of FIG. 3.

Another preferred embodiment of the feedthrough assembly is shown in FIGS. 3 and 5. The feedthrough tube 16, the electrode assembly 26 and the crimp 50 are constructed in the same manner shown in FIG. 2 and described hereinabove. A connection wire or strap 76 includes a circumferential portion 78 which at least partially encircles the electrode feedthrough tube 16, an axial section 80 and a section 82 which interconnects circumferential portion 78 and axial section 80. The axial section 80 extends from the outer end 46 of feedthrough tube 16 along the central axis of feedthrough tube 16. Since the feedthrough assembly is centrally located in arc tube 10, the axial section is located on the axis of arc tube 10. The axial section 80 is used to hold the arc tube assembly together during sealing, as described hereinafter. In a preferred embodiment, the circumferential sections 70 and 78 of straps 24 and 76 can be flattened to insure good contact with feedthrough tube 16.

During sealing of an arc tube which includes end member 12 and sealing ring 18, as shown in FIG. 1, the arc tube 10 is positioned in a vertical orientation in a furnace having the desired gas fill and pressure, with the end to be sealed in the upper position. A frit ring is positioned on the end member 12, and the sealing ring 18 is positioned over the frit. The electrode feedthrough assembly is inserted through the sealing ring 18 and is positioned relative to the sealing ring 18 by contact between circumferential section 70 or 78 and sealing ring 18. The upper end of strap 24 or 76 presses against a solid member at the top of the furnace. The lower end of the arc tube 10 rests on a spring-loaded surface. Thus, the electrode feedthrough assembly is prevented from moving relative to the arc tube during sealing due to positive pressure within the arc tube 10. Such movement is a common occurrence during sealing, especially with high pressure xenon fills. The strap 76 having axial section 80 is particularly advantageous in retaining the electrode feedthrough assembly in position during sealing since the axial section 80 is on the central axis of the arc tube assembly, and tipping is avoided.

Electrode assemblies have been constructed using 0.030 inch diameter niobium wire, with niobium tubing of 0.156 inch and 0.085 inch diameter having one end closed. When securing strap 24, 76 to the niobium feedthrough, great care must be taken to avoid distorting the outer diameter of niobium tube 16. Electrical resistance welding cannot readily be used due to the pressure exerted and the possibility of distorting the niobium tube. Laser welding has been found to be successful. Care must be taken to avoid puncturing the niobium tube with the laser. One way to improve reliability is to flatten the wire. The 0.030 inch diameter round wire is flattened to dimensions of 0.015 by 0.043 inch. The wider dimension is in contact with the outside surface of the niobium feedthrough tube, thereby providing a larger target for the laser weld and requiring less energy to form the weld. The above-described technique has been utilized without difficulty with 0.085 inch diameter niobium tubing in 70 and 100 watt high pressure sodium lamps and with 0.156 inch outer diameter niobium tubing in 400 watt high pressure sodium lamps. Two welds along the circumferential section of the strap, one near the part which extends along the axis of the tube and one at the opposite end provide good rigidity during sealing.

In an example of the electrode feedthrough assembly of the present invention, 400 watt unsaturated vapor lamps utilizing arc tubes with insert buttons were tested. The arc tubes were 10.2 millimeters outside diameter and 108 millimeters cavity length. An opening of about 0.160 inch is provided in the insert button. The button opening accommodated niobium tubing of 0.156 outside diameter. The sealing ring was 3 millimeters thick and had an opening of 0.160 inch. The lamps contained various electrode geometries with a fill material of 3 milligrams, 3.4% by weight sodium in a sodium-mercury amalgam. Ten such lamps have been on test for 4000 hours without any failures.

The present invention is not limited to the arc tube construction shown in FIG. 1. For example, the sealing ring 18 can be omitted. Alternatively, a grooved arc tube sealing button can be utilized as disclosed in U.S. Pat. No. 4,713,580. In addition, it will be understood that the electrode feedthrough assembly of the present invention can be utilized either at one end or at both ends of the arc tube assembly. When only one of the above described electrode feedthrough assemblies is utilized, a conventional feedthrough assembly is utilized at the opposite end of the arc tube assembly.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A ceramic arc tube assembly comprising: a ceramic arc tube having an opening in at least one end; an electrode feedthrough sealed in said opening, said electrode feedthrough comprising a conductive tube closely matched in thermal characteristics to said arc tube and having a central axis; a conductive strap electrically and mechanically coupled to said conductive tube outside said arc tube, said conductive strap including a first section that at least partially encircles said conductive tube and is attached thereto, a second section extending coincident with said central axis of said conductive tube, and a third section that interconnects said first and second sections; and an electrode assembly coupled to said electrode feedthrough in an interior of said arc tube.

2. A ceramic arc tube assembly as defined in claim 1 wherein said conductive strap is thermally matched to said electrode feedthrough.

3. A ceramic arc tube assembly as defined in claim 1 wherein said electrode feedthrough and said conductive strap comprise niobium.

4. A ceramic arc tube assembly as defined in claim 1 wherein said conductive strap includes a surface that matches the surface of said electrode feedthrough to facilitate contact between said conductive strap and said electrode feedthrough.

5. A ceramic arc tube assembly as defined in claim 1 wherein said conductive strap has a substantially rectangular cross-section.

6. A method of manufacturing a ceramic arc tube assembly, comprising the steps of:

providing a ceramic arc tube having a central axis and an opening in at least one end thereof and an electrode feedthrough comprising a conductive tube closely matched in thermal characteristics to said ceramic arc tube;

attaching a conductive strap to said electrode feedthrough, said conductive strap including a first section that at least partially encircles said conductive tube and is attached thereto, a second section extending coincident with said central axis of said ceramic arc tube, and a third section that interconnects said first and second sections;

positioning said electrode feedthrough in the opening in said ceramic arc tube with the first section of said conductive strap in contact with the periphery of the opening; and sealing said electrode feedthrough in said opening by heating a sealing material located between said electrode feedthrough and said ceramic arc tube.

7. A method as defined in claim 6 further including the step of retaining said electrode feedthrough in a fixed position relative to said ceramic arc tube during the step of sealing said electrode feedthrough in said opening by positioning a fixed member in axial contact with the third section of said conductive strap.

8. A method as defined in claim 6 wherein the step of attaching said conductive strap includes a welding of said conductive strap to said electrode feedthrough.

9. A method as defined in claim 6 wherein the step of attaching said conductive strap includes a laser welding of said conductive strap to said electrode feedthrough.

10. A method as defined in claim 9 further including the step of providing said conductive strap with a surface that matches a surface of said electrode feedthrough to facilitate contact therebetween.

* * * * *